US007317880B2

(12) United States Patent
Taguchi et al.

(10) Patent No.: US 7,317,880 B2
(45) Date of Patent: Jan. 8, 2008

(54) IMAGE FORMING DEVICE FOR CONTROLLING DENSITY ADJUSTMENT BASED ON A TYPE OF DEVELOPMENT UNIT

(75) Inventors: Keiichi Taguchi, Nagano-ken (JP); Ken Yoshizuka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 181 days.

(21) Appl. No.: 11/182,054

(22) Filed: Jul. 15, 2005

(65) Prior Publication Data

US 2006/0013599 A1 Jan. 19, 2006

(30) Foreign Application Priority Data

Jul. 15, 2004 (JP) ..... 2004-208239

(51) Int. Cl.
*G03G 15/00* (2006.01)

(52) U.S. Cl. ..... 399/12; 399/49

(58) Field of Classification Search ..... 399/12, 399/38, 49, 82; 347/19, 49, 86
See application file for complete search history.

(56) References Cited

U.S. PATENT DOCUMENTS 6,658,219 B1 * 12/2003 Ito et al. ..... 399/12 X
2005/0254837 A1 * 11/2005 Takahashi ..... 399/12
2006/0051106 A1 * 3/2006 Takahashi et al. ..... 399/12

FOREIGN PATENT DOCUMENTS

JP 2003-345180 A 12/2003

* cited by examiner

*Primary Examiner*—Sophia S. Chen
(74) *Attorney, Agent, or Firm*—Sughrue Mion, PLLC

(57) ABSTRACT

The image forming device enables adequate density adjustment control, regardless of which toner cartridge is mounted. The image forming device for conducting image formation by using a toner has a development device having detachably mounted thereon a development unit for accommodating the toner, a discrimination unit discriminating whether or not the development unit mounted on the development device is a product of guaranteed quality, and a control unit that controls the density adjustment processing of the development unit mounted on the development device and serves to execute different control with respect to the density adjustment processing when the development unit was identified as a product of guaranteed quality and when the development unit was not identified as a product of guaranteed quality by the discrimination unit.

5 Claims, 10 Drawing Sheets

FIG. 4

| CARTRIDGE | WHETHER OR NOT THE CARTRIDGE IS A PRODUCT OF GUARANTEED QUALITY |
|---|---|
| 611A | PRODUCT OF GUARANTEED QUALITY |
| 611B | PRODUCT OF GUARANTEED QUALITY |
| 611C | PRODUCT OF GUARANTEED QUALITY |
| 611D | PRODUCT WHOSE QUALITY IS NOT CONFIRMED BY MANUFACTURER |

IMAGE FORMING DEVICE FOR CONTROLLING DENSITY ADJUSTMENT BASED ON A TYPE OF DEVELOPMENT UNIT

BACKGROUND OF THE INVENTION

1. Field of the Invention

The present invention relates to an image forming device such as a printer, a copier, and a facsimile apparatus, and more particularly to an image forming device making it possible to conduct adequate density adjustment control.

2. Description of the Related Art

Image forming devices for forming images by using electrophotographic technology implemented in color printers or the like generally comprise an image carrier for forming an electrostatic latent image correspondingly to image data, a charging unit for charging the outer peripheral surface of the image carrier, an exposure unit for exposing the outer peripheral surface of the electrically charged image carrier and forming an electrostatic latent image, a development device for supplying a toner, which is a developing agent, to the electrostatic latent image and developing the toner image, and a transfer unit for transferring the toner image on the medium which is a transfer object.

In such an image forming device, a processing called image density adjustment is usually conducted so that the image output can be always conducted at a good image density. This density adjustment is conducted when characteristics relating to toner image formation on the image carrier supposedly change, for example, when the power source of the image forming device is turned on, after the execution of the prescribed number of image formation cycles, or when the image carrier is replaced. Further, this density adjustment is conducted by creating a pattern in the form of patches or fine lines under each operation condition on the image carrier, detecting the pattern density with a sensor, and conducting feedback to the operation conditions. For example, a development bias applied to the roller section of the toner cartridge accommodating the toner, which is provided in the development device, is varied and paint-out patches are produced at each bias value. Further, the density of each patch that was thus formed is measured, the development bias value at which the desired density value is assumed is found from those values, and the control is so conducted that this value is assumed.

Several methods for controlling such density adjustment have been suggested. In the device described in Japanese Patent Application Laid-open No. 2003-345180, a control method is employed by which when the device is set in a speed priority mode, the device start-up operation is conducted without executing the density adjustment and the time to image output is shortened.

On the other hand, among the toner cartridges mounted on the developing device, there are toner cartridges that guarantee that the image forming device can demonstrate the performance inherent thereto when the toner cartridge is mounted, that is, the toner cartridges manufactured and marketed, e.g., by the manufacturer of the image forming device, and other toner cartridges, that is, toner cartridges that were neither manufactured nor marketed by the manufacturer of the image forming device. The toner cartridges of the former group will be called hereinbelow the products whose quality was guaranteed by the manufacturer of the image forming device such as a printer and the toner cartridges of the latter group will be called the products whose quality has not been confirmed by the manufacturer of the image forming device such as a printer. In principle, the products of guaranteed quality have to be mounted and used in the image forming devices, but because the products whose quality has not been confirmed by the manufacturer are also marketed, the users sometimes mount and use those products whose quality has not been confirmed by the manufacturer.

As described hereinabove, the operation of density adjustment control has been conducted in image forming devices, but such a control did not take into account whether or not the toner cartridge mounted on the image forming device is the above-described product of guaranteed quality.

In the usual cases, it is assumed that a toner cartridge that is a product of guaranteed quality is mounted on the image forming device. Therefore, the above-described density adjustment is also controlled based on the contents suitable for the toner cartridge of guaranteed quality, for example, so that in the above-described adjustment of development bias, the processing is executed according to a range suitable for products with guaranteed quality. Therefore, in the conventional devices, even when a toner cartridge whose quality has not been confirmed by the manufacturer is mounted, because this fact is not taken into account, the density adjustment is conducted based on the same contents as that for the products of guaranteed quality. Generally, the toner cartridges themselves and properties of toners accommodated therein sometimes differ between the products of guaranteed quality and products whose quality has not been confirmed by the manufacturer. Therefore, sometimes the density adjustment is not conducted by the same method. In this case, as described above, if a product whose quality has not been confirmed by the manufacturer is mounted, the density adjustment processing generates an error and processing is interrupted. Further, even if the density adjustment processing ends without generating an error, good adjustment results sometimes cannot be obtained. Thus, problems are still associated with the density adjustment control in the conventional devices.

SUMMARY OF THE INVENTION

Accordingly, it is an object of the present invention to provide an image forming device enabling adequate density adjustment control, regardless of which toner cartridge is mounted.

In order to attain the above-described object, in accordance with the first aspect of the present invention, there is provided an image forming device for conducting image formation by using a toner, this device comprising development means which has detachably mounted thereon a development unit for accommodating the toner, discrimination means which discriminates whether or not the development unit mounted on the development means is a product of guaranteed quality, and control means that is means to control the density adjustment processing of the development unit mounted on the development means and serves to execute different control with respect to the density adjustment processing when the development unit is identified as a product of guaranteed quality and when the development unit is not identified as a product of guaranteed quality by the discrimination means. Therefore, the present invention makes it possible to resolve the problem of the conventional control in which the density adjustment designed for a product of guaranteed quality is always conducted, regardless of whether or not the mounted development unit is a product of guaranteed quality. Thus, when the mounted development unit is a product whose quality has not been confirmed by the manufacturer, the density adjustment control suitable therefor is implemented and the situation in which the density adjustment designed for products of guaranteed quality is inappropriately conducted and an error is generated can be avoided.

Further, in one mode of the above-described invention, the control means conducts control so that the density adjustment processing is not conducted when the development unit is not identified as a product of guaranteed quality by the discrimination means. As a result, it is possible to avoid the problem of conducting the density adjustment processing designed for a product of guaranteed quality that can be unsuitable for the development unit that is a product whose quality has not been confirmed by the manufacturer.

Further, in another mode of the above-described invention, the control means judges whether or not the density adjustment processing, which is conducted when the development unit is identified as a product of guaranteed quality by the discrimination means, is possible when the development unit is not identified as a product of guaranteed quality by the discrimination means, and conducts control such that the density adjustment processing is conducted when it is judged to be possible and the density adjustment processing is not conducted when it is judged to be impossible. As a result, the density adjustment can be prevented from being inappropriately conducted when the mounted development unit is a product whose quality has not been confirmed by the manufacturer and the density adjustment designed for a product of guaranteed quality is impossible.

Further, in another mode of the above-described invention, the control means judges whether or not the density adjustment processing with respect to the development unit that is not identified as the product of guaranteed quality in the image forming device is possible when the development unit is not identified as the product of guaranteed quality by the discrimination means, and conducts control such that the density adjustment processing is conducted when it is judged to be possible and the density adjustment processing is not conducted when it is judged to be impossible. As a result, the density adjustment processing can be conducted as properly as possible and the output with good image quality can be maintained even when the mounted development unit is a product whose quality has not been confirmed by the manufacturer.

Further, in another mode of the above-described invention, the adjustment of a development bias value in the development means is included in the density adjustment processing controlled by the control means, and when the development unit is not identified as a product of guaranteed quality by the discrimination means, a judgment is made as to whether or not the density adjustment processing is possible within an allowed adjustment range of the image forming device that is wider than the adjustment range of the development bias value in the case where the development unit is identified as a product of guaranteed quality by the discrimination means, and the control is conducted such that the adjustment of the development bias value is conducted when it is judged to be possible and the adjustment of the development bias value is not conducted when it is judged to be impossible.

Other objects and features of the present invention will become apparent from the following description of the embodiments of the invention.

BRIEF DESCRIPTION OF THE DRAWINGS

FIG. 4 shows, by the way of an example, whether or not the toner cartridge of the printer 2 is a product of guaranteed quality;

DESCRIPTION OF THE PREFERRED EMBODIMENTS

Figure 1:
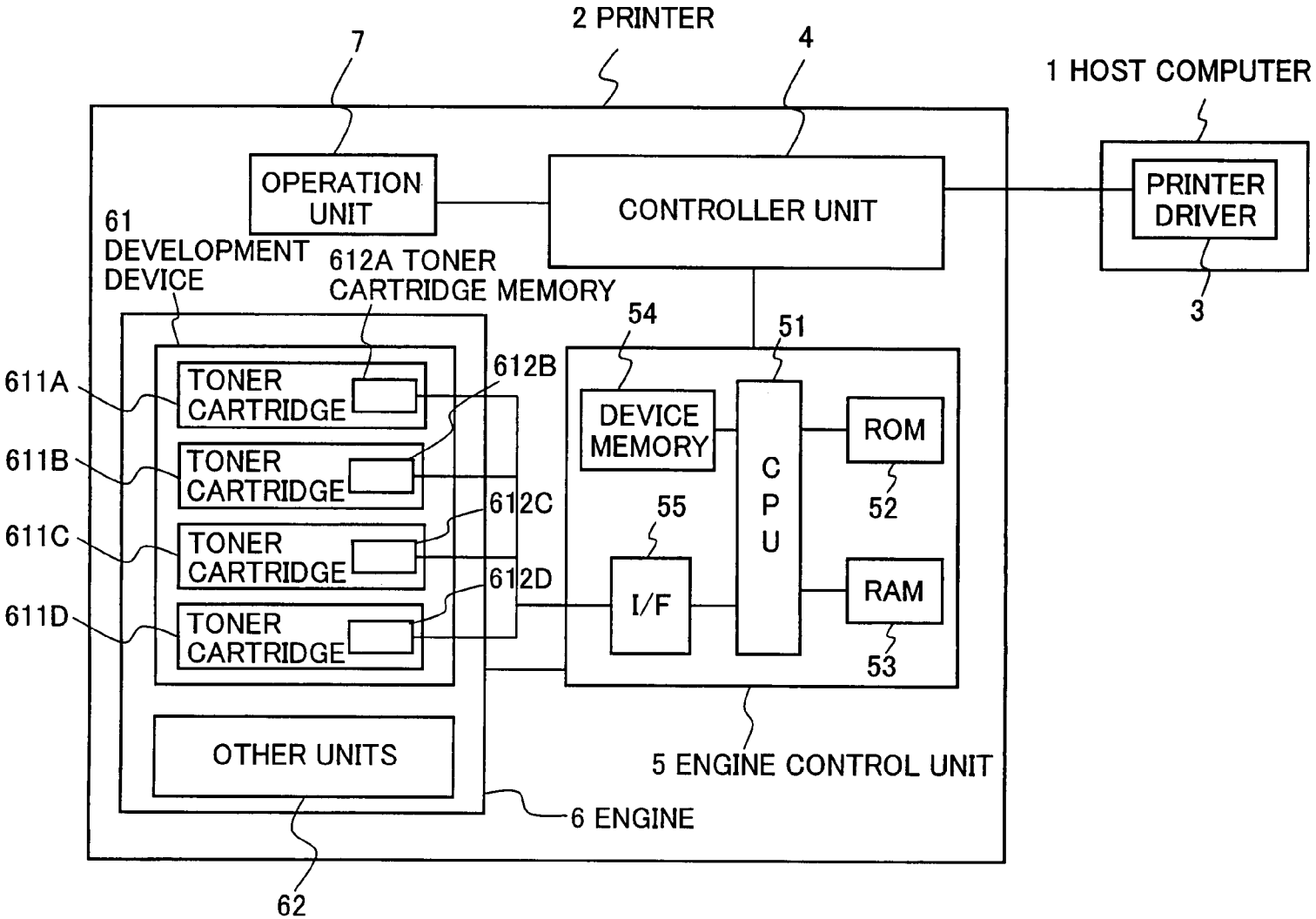
FIG. 1 is a structural drawing relating to an embodiment of the image forming device employing the present invention.

The embodiments of the present invention will be explained below with reference to the appended drawings. However, those embodiments do not limit the technological scope of the invention. In the drawings, the same or identical components are assigned with the same reference numbers or reference symbols.

FIG. 1 is a structural diagram relating to an embodiment of a printer that is an image forming device employing the present invention. A printer 2 shown in FIG. 1 is an image forming device employing the present invention and conducts the formation of images on the prescribed printing medium based, e.g., on a printing request from a host computer 1. The printer 2 discriminates whether or not a toner cartridge 611 mounted thereon (development unit) is a product of guaranteed quality, controls the density adjustment relating to each toner cartridge 611 based on the discrimination results, and conducts adequate density adjustment control when the toner cartridge 611 of any type is mounted.

The host computer 1 shown in FIG. 1 is a host device for issuing a print request to the printer 2; the host computer transmits to the printer 2 the print data comprising image data and control command based on the user's operations or the like. The host computer 1 can be composed of the so-called personal computer. A printer driver 3 located inside the host computer 1 is a unit for receiving the data, e.g., from an application (not shown in the figure) located inside the host computer 1 and generating the aforementioned print data to be transmitted to the printer 2. The printer driver 3 is a program for executing in the host computer 1 the processing relating to the above-described functions.

As shown in FIG. 1, the printer 2 comprises a controller unit 4, an engine control unit 5, an engine 6, and an operation unit 7. The controller unit 4 receives the print data transmitted from the host compute 1, interprets the control command contained in the data, conducts the prescribed processing of the image data contained in the data, and generates data to be supplied to the engine 6. The controller unit 4 comprises a CPU and a memory (not shown in the figure), and above-mentioned generated data are stored in the memory. Further, the controller unit 4 issues a request for the density adjustment processing to the engine control unit 5 when the power of the printer 2 is turned on, when the printing processing has been executed the prescribed number of times, when the below-described photosensitive drum 621 has been replaced, or when the toner cartridge 611 has been replaced.

Further, the engine control unit 5 is composed, as shown in FIG. 1, of a CPU 51 (discrimination means, control means), a ROM 52, a RAM 53, a device memory 54, and an I/F 55, etc. The CPU 51 is a unit for controlling all the units of the engine 6, but it also controls the density adjustment processing upon receiving the density adjustment request from the above-described controller unit 4, and the specific feature is in the density adjustment control. The specific control contents will be described below.

The ROM 52 stores various programs for controlling the engine 6, and the RAM 53 temporarily stores various information relating to the engine 6. Further, the device memory 54 is data storage means for storing the information relating to each toner cartridge 611 of the below-described development device 61. More specifically, it stores information relating to the presence or absence of the toner cartridge 611 in the development device 61, color information of the toner written into the below-described memory 612A-612D of the toner cartridge, consumption information, and the like.

Further, the I/F 55 is an interface of the CPU 51 and toner cartridge memory 612A-612D and is used when the CPU 51 reads the information written in the toner cartridge memory 612A-612D and writes it into the device memory 54.

Figure 2:
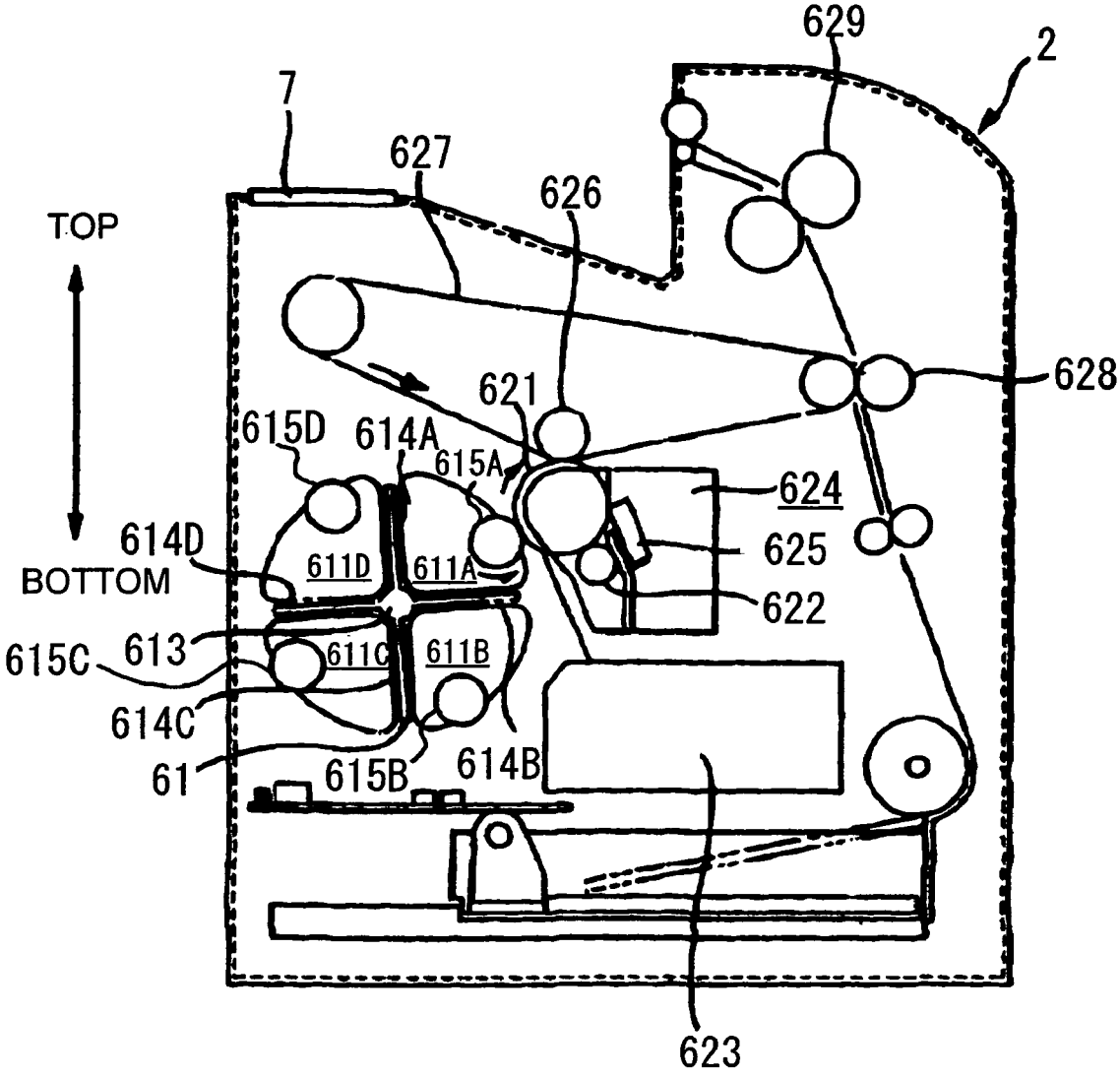
FIG. 2 is a structural drawing illustrating mainly the structure of the engine 6 section of the printer 2.

Further, the engine 6 is composed of an electrostatic unit, an exposure unit, a development device, and a transfer unit, etc. In FIG. 1, it is represented by segments of the development device 61 (development means) and other units 62. FIG. 2 is a structural drawing illustrating mainly the mechanism of the engine 6 section of the printer 2.

A photosensitive drum 621 comprises a cylindrical electrically conductive substrate and a photosensitive layer formed on the outer peripheral surface thereof and rotates clockwise, as shown by a arrow. The electrostatic unit 622 charges the photosensitive drum 621, the exposure unit 623 illuminates the charged photosensitive drum 621 with a beam from a light source such as a laser or LED array located inside thereof and forms a latent image by electrostatic charges. Beam illumination of the exposure unit 623 is controlled by drive signals modulated based on the image information inputted from the host computer 1.

The development device 61 has mounting sections 614A-614D for detachable mounting of toner cartridges 611A-611D accommodating toners, which are the developing materials, and is a development rotary that can rotate about a central axis 613. The latent image is developed into an image composed of the developing materials by rotating the development device 61, bringing the necessary toner cartridge 611A-611D close to the photosensitive drum 621 and supplying the developing material to the photosensitive drum 621, which has the latent image formed thereon, by a development bias applied to development rollers 615A-615D.

Mounting by combining toners of various colors, for example, by mounting toner cartridges 611A-611D accommodating respective developing materials of black K, cyan C, magenta M, and yellow Y colors on the mounting sections 614A-614D of the development device 61 is also possible, but in the present embodiment, all the mounted toner cartridges 611A-611D are assumed to accommodate a black K toner. Further, those toner cartridges 611A-611D are not always only the "products of guaranteed quality" and sometimes some of them are toner cartridges that are the "products whose quality has not been confirmed by the manufacturer". The symbols A-D assigned to the toner cartridges 611A-611D identify the mounting position of toner cartridges 611 in the development device 61.

A primary transfer unit 626 transfers the toner image formed on the photosensitive body 621 onto an intermediate transfer body 627. The intermediate transfer body 627 is, for example, an endless belt in which an aluminum deposited layer is formed on the surface of a PET film and a semiconductor coating is formed on the surface thereof; it is rotary driven at the same circumferential speed as the photosensitive drum 621. The secondary transfer unit 628 transfers the toner image, which was formed on the intermediate transfer body 627, onto a printing medium such as paper. A fixing unit 629 fuses the toner image transferred onto the printing medium, thereby producing a permanent image. The printing medium is then discharged to the outside of the printer 2.

A cleaning unit 624 is provided between the primary transfer unit 626 and electrostatic unit 622 and has a cleaning blade 625 abutted against the surface of the photosensitive drum 621. The developing material (toner) remaining on the photosensitive drum 621 after the primary transfer is removed by the cleaning blade 625.

Further, each toner cartridge 611 is provided with a toner cartridge memory 612A-612D, which is a storage medium, for example, a contactless non-volatile memory, for storing color information or residual amount information of the developing material, so that the printer 2 can verify the state of the mounted toner cartridge 611. This information of the toner cartridge memory 612A-612D is read after the power source has been turned on or after the toner cartridge 611 has been mounted on the development device 61. Further, the residual amount information of the toner cartridge memory 612A-612D of the toner cartridge 611 is updated after the development. The toner cartridge memory 612A-612D may also contain information for judging whether or not the toner cartridge 611 is a product of guaranteed quality, such as information relating to the manufacturer or number of recycle cycles of the toner cartridge 611.

The operation unit 7 shown in FIG. 1 is a unit allowing the user to operate the printer 2; it is composed of a display panel, control buttons, and the like. The operation unit 7 can be used for setting, e.g., printing conditions in the printer 2.

During printing in the printer 2 of the present embodiment having the above-described configuration, the aforementioned printing data described with the prescribed language are supplied from the host computer 1, and the operations of forming an electrostatic latent image on the photosensitive drum 621, developing with the corresponding toner cartridge 611, and transferring a toner image formed by the primary transfer unit 626 onto the intermediate transfer body 627. Then, the image is transferred by the secondary transfer unit 628 onto the printing medium such as paper. After fixing with the fixing unit 629, the printing medium is discarded from the printer 2. In order to maintain good image quality, the density adjustment processing is conducted at the prescribed timing. A specific feature of this printer 2 is in the density adjustment control, and this issue is described below in greater detail.

Figure 3:
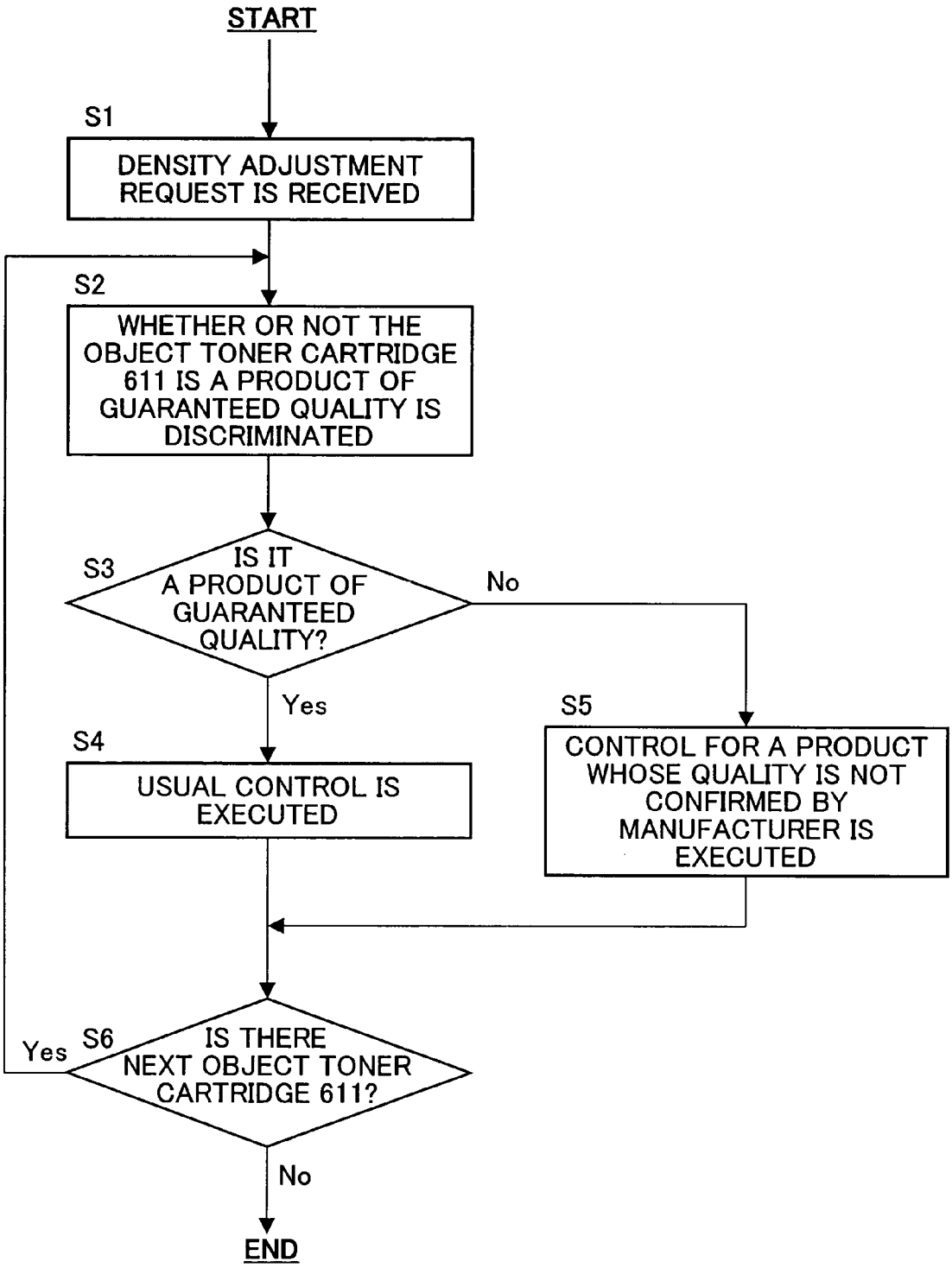
FIG. 3 is a flowchart showing an example of the contents of the density adjustment control conducted by the CPU 51.

FIG. 3 is a flowchart illustrating the contents of the density adjustment control conducted by the CPU 51 when the printer 2 executes the density adjustment processing. First, the CPU 51 receives the density adjustment request issued by the controller unit 4 (step S1). As described above, this density adjustment request is issued when the power source of the printer 2 is turned on, when the printing processing has been executed the prescribed number of times, when the photosensitive drum 621 has been replaced, or when the toner cartridge 611 has been replaced.

If the density adjustment request is received, the CPU 51 starts controlling the density adjustment processing with respect to each toner cartridge 611A-611D. First, it discriminates whether or not the toner cartridge 611 that is the object of density adjustment is a product of guaranteed quality (step S2). The discrimination processing can be conducted by a variety of methods. For example, the above-mentioned toner cartridge memory 612A-612D can be accessed and whether or not the toner cartridge is a product of guaranteed quality can be judged from the information relating to the manufacturer and recorded in the toner cartridge memory. Further, information on whether or not the mounted toner cartridges 611A-611D are the products of guaranteed quality may be created in advance and stored in a tabular format in the device memory 54 or the like. In this case, the CPU 51 can easily conduct the above-described discrimination processing by accessing this table. The information on whether or not the toner cartridges are the products of guaranteed quality, which was created in advance, may be automatically generated by the CPU 51 making a judgment based on the information stored in the toner cartridge memory 612A-612D, for example, when the toner cartridge 611 is replaced, and when the user of the printer 2 knows whether or not the toner cartridge is a product of guaranteed quality, the user may input this information by operating the operation unit 7 or host computer 1.

When the results of the discrimination processing demonstrated that the object toner cartridge 611 is a product of guaranteed quality (Yes in step S3), the CPU 51 controls each unit of the engine 6 so that the usual density adjustment processing is conducted (step S4). Thus, the control is carried out so as to conduct the density adjustment suitable for the toner cartridge 611, which is the product of guaranteed quality. On the other hand, when the object toner cartridge 611 is a product whose quality has not been confirmed by the manufacturer (No in step S3), the CPU 51 executes the density adjustment control for the product whose quality has not been confirmed by the manufacturer (step S5). FIG. 4 shows an example of results on whether or not the toner cartridges 611 mounted on the printer 2 are the products of guaranteed quality. In the case of the example shown in FIG. 4, the usual density adjustment control is conducted when the object toner cartridge is the toner cartridge 611A-611C, but the density adjustment control for the product whose quality has not been confirmed by the manufacturer is conducted when the toner cartridge is the toner cartridge 611D.

If the density adjustment processing is thus conducted based on the usual density adjustment control or density adjustment control for the product whose quality has not been confirmed by the manufacturer, the CPU 51 checks whether the next toner cartridge 611 for which density adjustment has to be conducted is present (step S6). If the next object is present (Yes in step S6), the processing from step S2 is similarly conducted. If the next object is not present (No in step S6), that is, if the processing has been conducted with respect to all the toner cartridges 611 for which the adjustment has to be conducted in response to the current density adjustment request, the density adjustment control of this sequence is completed.

Figure 5:
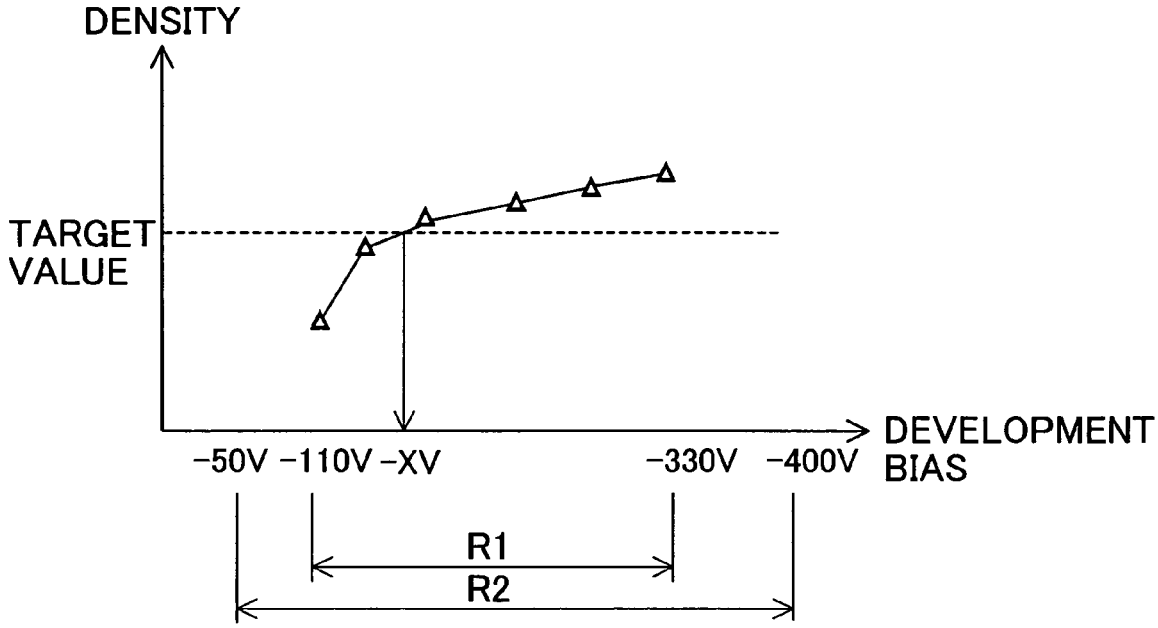
FIG. 5 illustrates the adjustment of development bias.

Thus, in the density adjustment control in the printer 2, the control differs depending on whether the object toner cartridge 611 is a product of guaranteed quality or a product whose quality is not confirmed by the manufacturer and this difference is an important specific feature. An example of density adjustment processing conducted by the usual control (step S4) will be described below. FIG. 5 explains the adjustment of development bias. The adjustment of development bias, which is one of the density adjustment processing procedures, will be explained based on FIG. 5.

First, CPU 51 issues a command to produce the respective paint-out patches by a plurality of different development bias values. In response to this command, the engine 6 is actuated, the toner cartridge 611 is brought close to the photosensitive drum 621, each development bias value is applied, and a toner image is formed. Then, the density of each patch that was formed is measured with a sensor (not shown in the figure).

Various development bias values for which patches have been formed and the measured densities of each patch are plotted (triangles in the figure) in FIG. 5. In this example, the adjustment range R1 of the usual development bias (of the product of guaranteed quality) is set to −110V to −330V, and the patch formation by six different bias values is conducted within this range.

Then, the CPU 51 finds the development bias at which the density (dot line in FIG. 5) of the predetermined target values is assumed from the relationship between the density values and development bias values of each patch obtained as described above. More specifically, as shown in FIG. 5, linear interpolation is conducted between the points plotted with respect to each patch (triangles in the figure) and the development bias value (−XV) that corresponds to a target density is found from the development bias-density curve (more accurately, broken line) thus obtained. Control is then conducted so that the found development bias value is assumed. R2 shown in FIG. 5 indicates the allowed adjustment range for the development bias of the printer 2. In this example, the adjustment is possible within a range of −50 V to −400 V.

Figure 6:
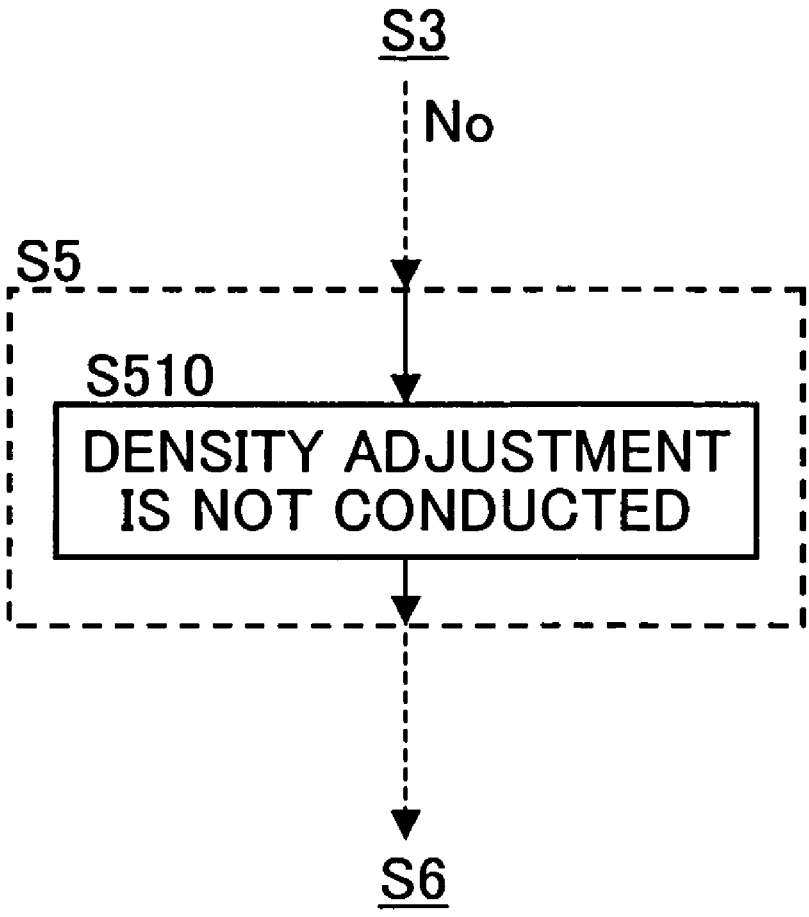
FIG. 6 is a flowchart illustrating a first control method relating to the case of a product whose quality has not been confirmed by the manufacturer.

An example relating to the usual density adjustment (for a product of guaranteed quality) was explained above. The control carried out in the case of a product whose quality has not been confirmed by the manufacturer (step S5 in FIG. 3) will be described hereinbelow in detail. Here, three control methods will be described. With the first method, when the object toner cartridge 611 is a product whose quality has not been confirmed by the manufacturer, the control is carried out so that density adjustment is not conducted. FIG. 6 is a flow chart illustrating this first method. As shown in the figure, with this method, when the toner cartridge is identified as a product whose quality has not been confirmed by the manufacturer (No in step S3), the density adjustment processing with respect to this toner cartridge 611 is ended without conducting the density adjustment processing (step S510) and the processing flow moves to the next toner cartridge 611 (step S6). Thus, with the first method, no density adjustment is conducted with respect to the toner cartridge 611 which is a product whose quality has not been confirmed by the manufacturer and which does not indicate clearly how to conduct the density adjustment. Therefore, it is possible to avoid conducting the inappropriate usual density adjustment (designed for a product of guaranteed quality) and generating errors.

Figure 7A:
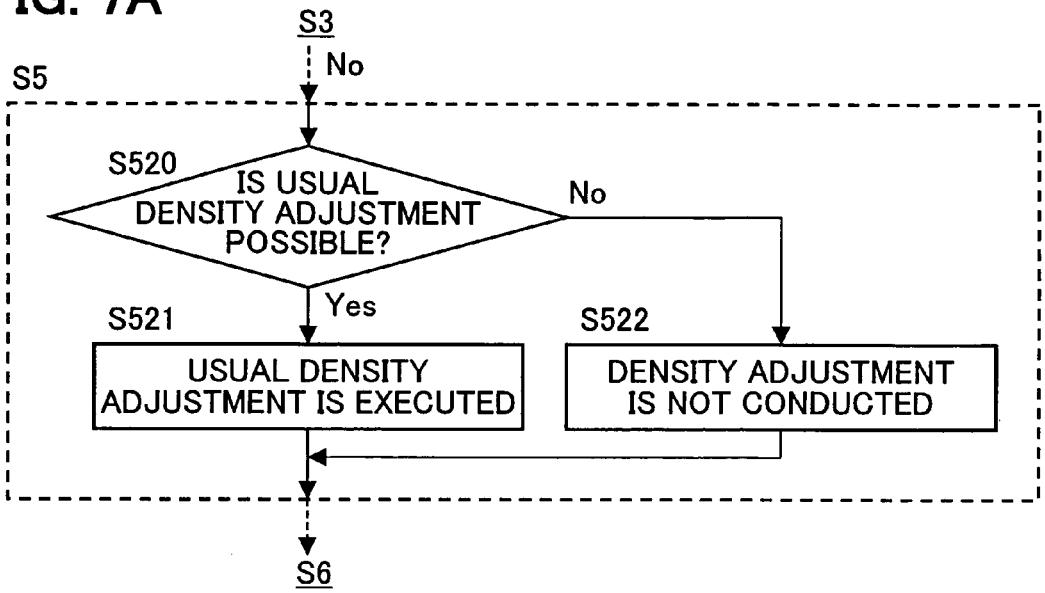
FIGS. 7A-B are flowcharts illustrating a second control method relating to the case of a product whose quality has not been confirmed by the manufacturer.

FIG. 7 is a flow chart illustrating the second control method conducted in the case of a product whose quality has not been confirmed by the manufacturer. With the second method, as shown in FIG. 7A, first, a judgment is made as to whether or not the usual density adjustment is possible (step S520). When the density adjustment is judged to be possible (Yes in step S520), control is carried out so as to conduct the usual density adjustment (designed for a product of guaranteed quality) and density adjustment is executed (step S521). On the other hand, when the density adjustment is judged to be impossible (No in step S520), the control is carried out so that the density adjustment is not conducted (step S522).

Figure 8:
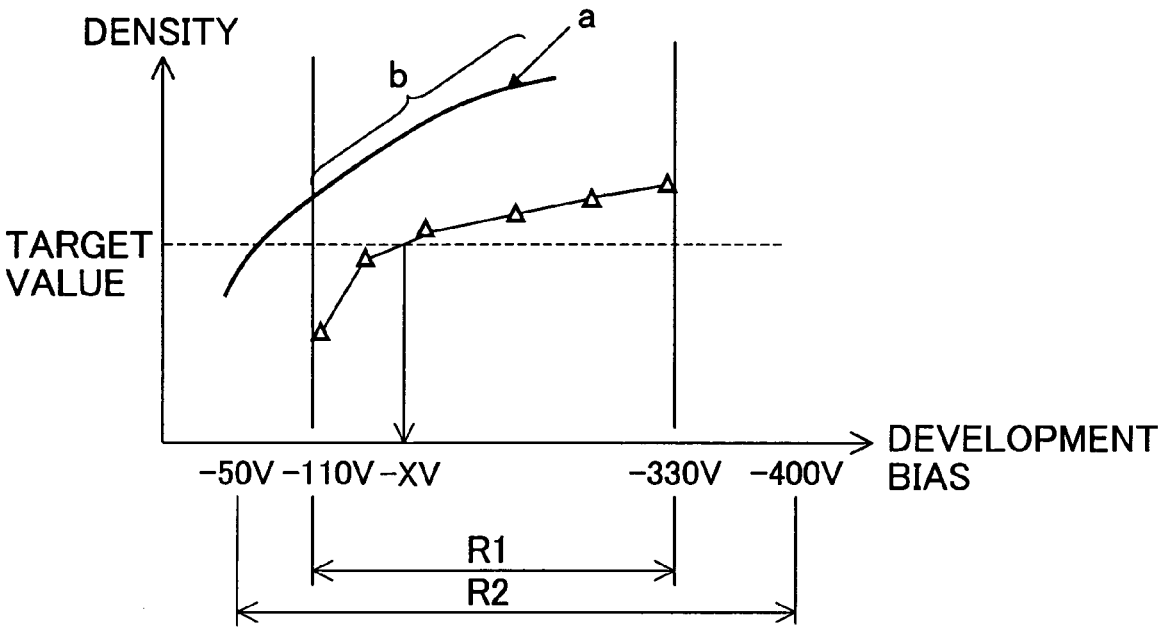
FIG. 8 illustrates the second method relating to the case of a product whose quality has not been confirmed by the manufacturer.

FIG. 8 illustrates the second method. FIG. 8, similarly to FIG. 5, illustrates the relationship between the density and the development bias. For example, when the characteristic of the toner cartridge 611, which is a product whose quality has not been confirmed by the manufacturer and is an adjustment object, is represented by a curve (a) shown in the figure, the density does not assume a target value in the above-described usual adjustment range R1 (see portion (b) in FIG. 8). Therefore, in this case, the usual density adjustment is judged to be impossible.

Figure 7B:
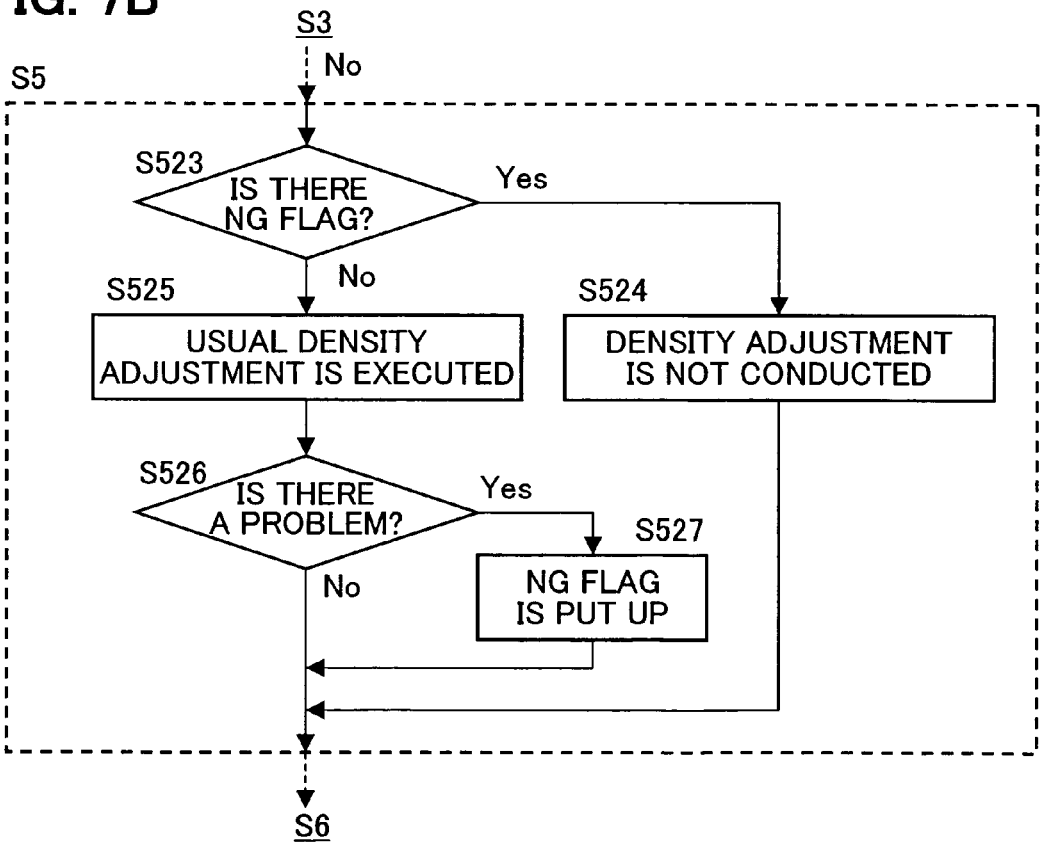

Further, FIG. 7B is a flow chart illustrating the second method in greater detail. According to this example, first, it is checked whether or not a NG flag is put up with respect to the toner cartridge 611 considered as an object (step S523). This NG flag means that the usual density adjustment is impossible and is added to each corresponding toner cartridge 611. This NG flag is contained in each toner cartridge memory 612A-612D or device memory 54 and is erased when the toner cartridge 611 is replaced.

When the checking results show that no NG flag is present (No in step S523), the usual density adjustment is executed (step S525). Further, if the adjustment is executed without problems (Yes in step S526), then control with respect to this toner cartridge 611 is ended, but when the adjustment was not conducted appropriately, for example, an error has occurred (No in step S526), then the above-mentioned NG flag is put up on the toner cartridge 611 (step S527) and the control is ended. On the other hand, in the case where the NG flag has already been put up (Yes in step S523), the control relating to the toner cartridge 611 is ended without executing the density adjustment (step S524).

Thus, in the example shown in FIG. 7B, even in the case of a product whose quality has not been confirmed by the manufacturer, the usual density adjustment is once attempted and the possibility of usual density adjustment is judged. When the usual density adjustment is judged to be impossible, this fact is represented by the NG flag and the density adjustment is thereafter not conducted based on the NG flag.

As described hereinabove, with the second method, even when the toner cartridge 611 is a product whose quality has not been confirmed by the manufacturer, if the usual density adjustment is possible, the density adjustment is executed and the output at a good density is realized, but when the usual density adjustment is impossible, the number of cases where the density adjustment is conducted and error is produced can be reduced.

Figure 9A:
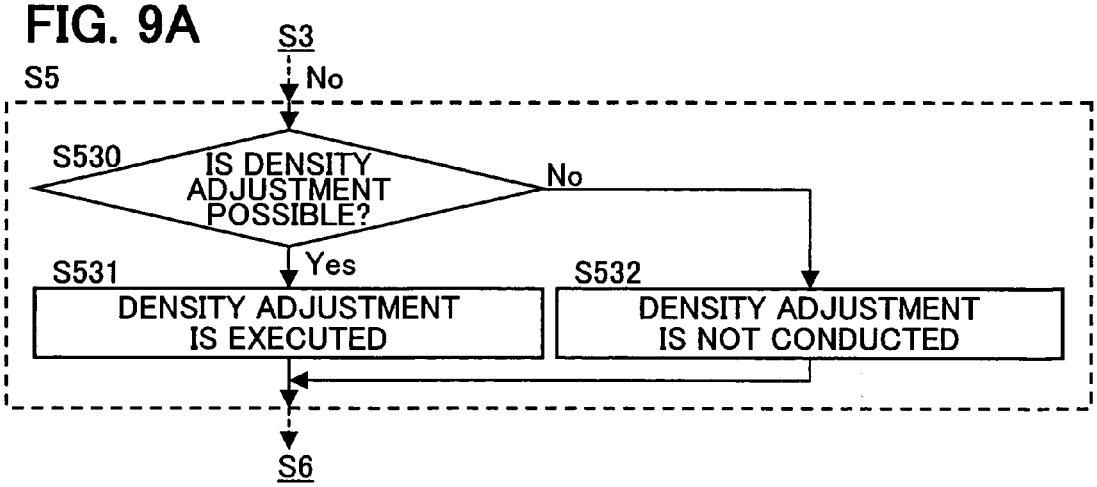
FIGS. 9A-B are flowcharts illustrating a third control method relating to the case of a product whose quality has not been confirmed by the manufacturer.
Figure 9B:
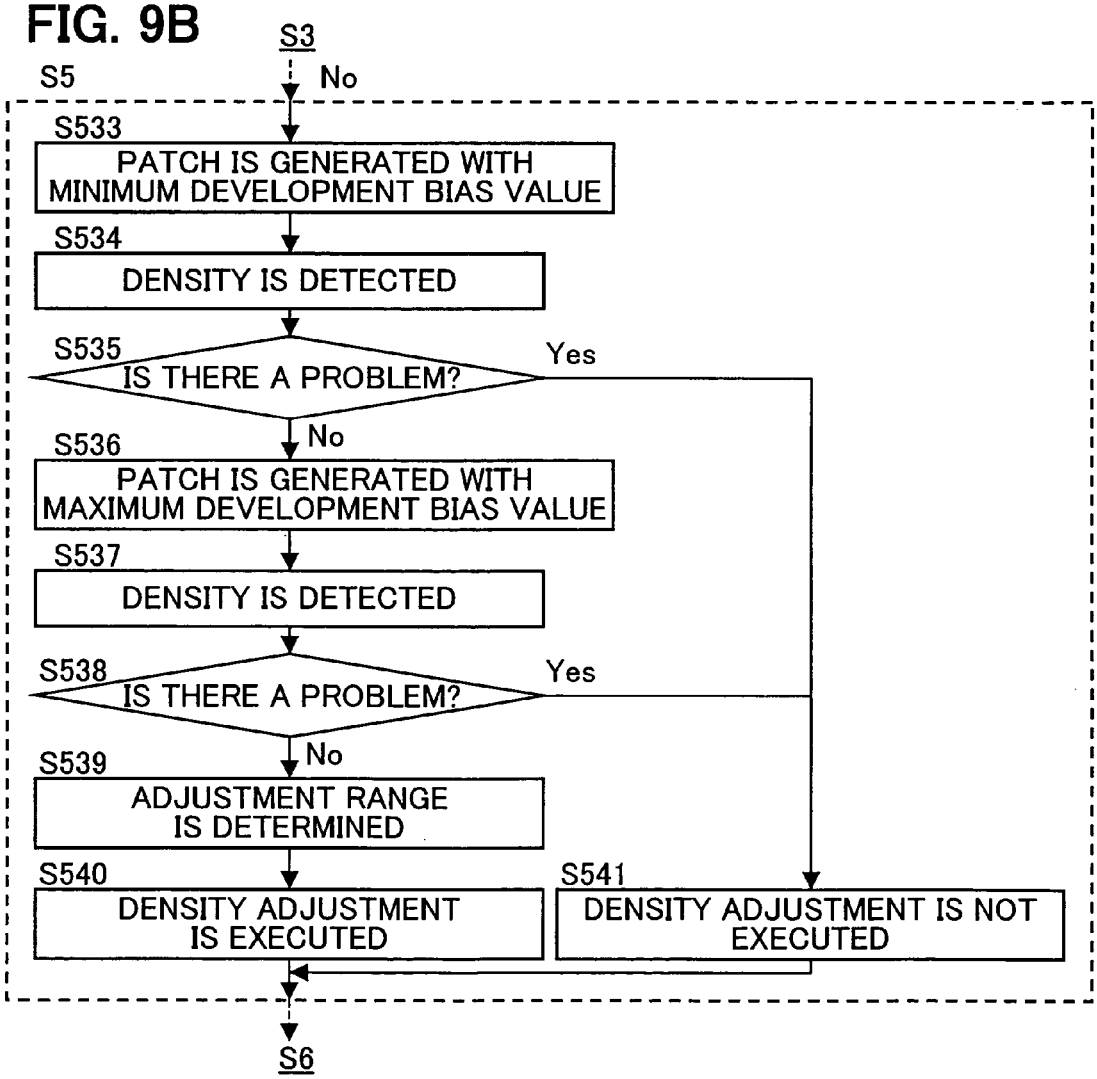

FIG. 9 is a flow chart illustrating the third control method relating to a product whose quality has not been confirmed by the manufacturer. With the third method, as shown in FIG. 9A, first, it is checked whether or not the density adjustment is possible, regardless of whether or not it is the usual density adjustment, with respect to the toner cartridge 611 considered as an object (step S530). When the density adjustment is judged to be possible (Yes is step S530), the density adjustment is executed (step S531). On the other hand, when it is judged to be impossible (No in step S530), the control is carried out so that no density adjustment is conducted (step S532). Thus, the control is so carried out that if density adjustment can be conducted in the printer 2 with respect to a product which is considered as an object and whose quality has not been confirmed by the manufacturer, then the density adjustment is conducted, and when the density adjustment is not possible, it is not executed. Here, the judgment as to whether or not the density adjustment is possible can be made by a variety of methods. An example of specific processing conducted by the third method will be explained below based on the flowchart shown in FIG. 9B, including an example of the judgment.

FIG. 9B shows an example relating to the case where the adjustment of the above-described development bias value is conducted with respect to the toner cartridge 611 that is a product whose quality has not been confirmed by the manufacturer. First, the patch at the lowest possible development bias value (strictly speaking, the development bias value with a minimum absolute value) is generated (step S533). FIG. 10 explains the method illustrated by FIG. 9B. In the example shown in FIG. 10, patch generation at the minimum development bias value means that patch generation is conducted at a minimum value −50 V of the allowed adjustment range R2 of the above-described printer 2.

Figure 10A:
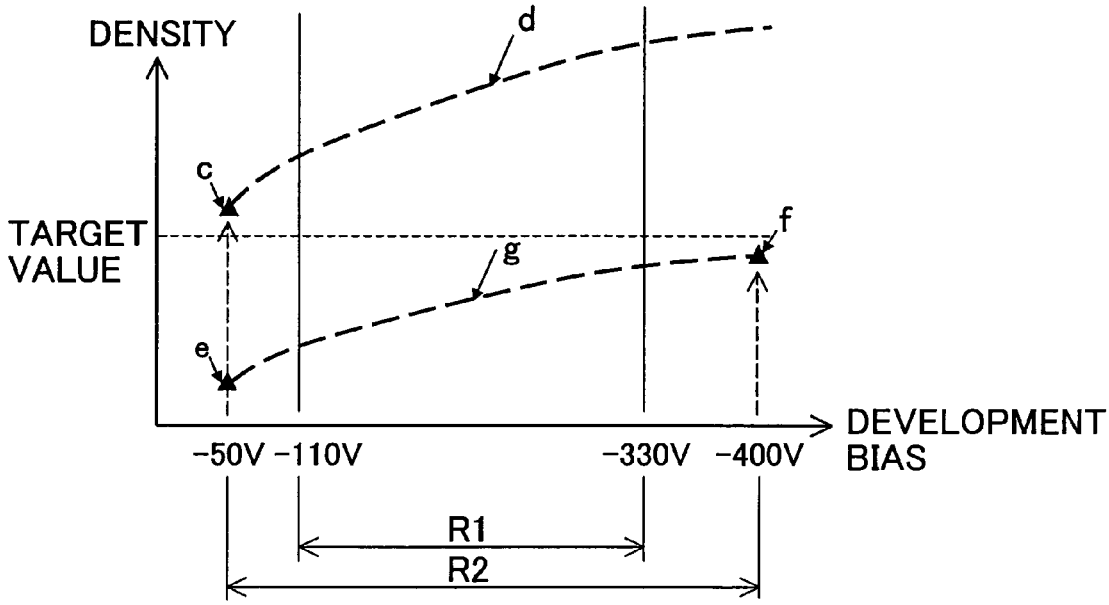
FIGS. 10A-B are figures for explaining the method illustrated by FIG. 9B.

Then, the density is detected with respect to the generated patch (step S534) and whether or not a problem is associated with the density is checked (step S535). Whether there is a problem is judged, for example, by whether the detected density value is higher than the target value. As shown in FIG. 10A, it can be anticipated that the relationship between the development bias and density will assume the form of the curve shown by (d) in the figure, in other words, that the density will not be at a target value when the development bias value is within the allowed adjustment range R2 in the case where the plot is in the position shown in (c) with respect to the patch generated at the minimum development bias value, that is, in the case where the density at the minimum development bias value is higher than the target value. Therefore, in such a case, the judgment result is that the adjustment of the development bias value for obtaining good density value in the printer 2 is impossible and that there is a problem.

In the case where a problem is judged to be associated with the detected density value (Yes in step S535), as described hereinabove, because the appropriate density adjustment is impossible, the density adjustment processing is not executed (step S541). On the other hand, when no problem is judged to be associated with the detected value (No in step S535), the aforementioned patch generation is conducted at the largest possible development bias value (strictly speaking, the development bias value with a maximum absolute value) (step S536). In the example shown in FIG. 10, patch generation at the maximum development bias value means that patch generation is conducted at a maximum value of −400 V in the allowed adjustment range R2 of the above-described printer 2.

Then, the density is detected with respect to the generated patch (step S537) and whether or not a problem is associated with the density is checked (step S538). Whether there is a problem is judged, for example, by whether the detected density value is lower than the target value. As shown in FIG. 1 GA, it can be anticipated that the relationship between the development bias and density will assume the form of the curve shown by (g) in the figure, in other words, that the density will not be at a target value when the development bias value is within the allowed adjustment range R2 because the density at the minimum development bias value has been judged to be lower than the target value in the step S535 (e in FIG. 10(*a*)) in the case where the plot is in the position shown by (f) with respect to the patch generated at the maximum development bias value, that is, in the case where the density at the maximum development bias value is lower than the target value. Therefore, in such a case, the judgment result is that the adjustment of the development bias value for obtaining good density value in the printer 2 is impossible and that there is a problem.

In the case where a problem was thus judged to be associated with the detected density value (Yes in step S538), the appropriate density adjustment is impossible as was mentioned above, and the density adjustment processing is not executed (step S541). On the other hand, in the case where no problem was judged to be associated with the detected density value (No in step S538), the density adjustment has to be conducted with respect to the toner cartridge 611 and the adjustment range thereof is determined (step S539).

Figure 10B:
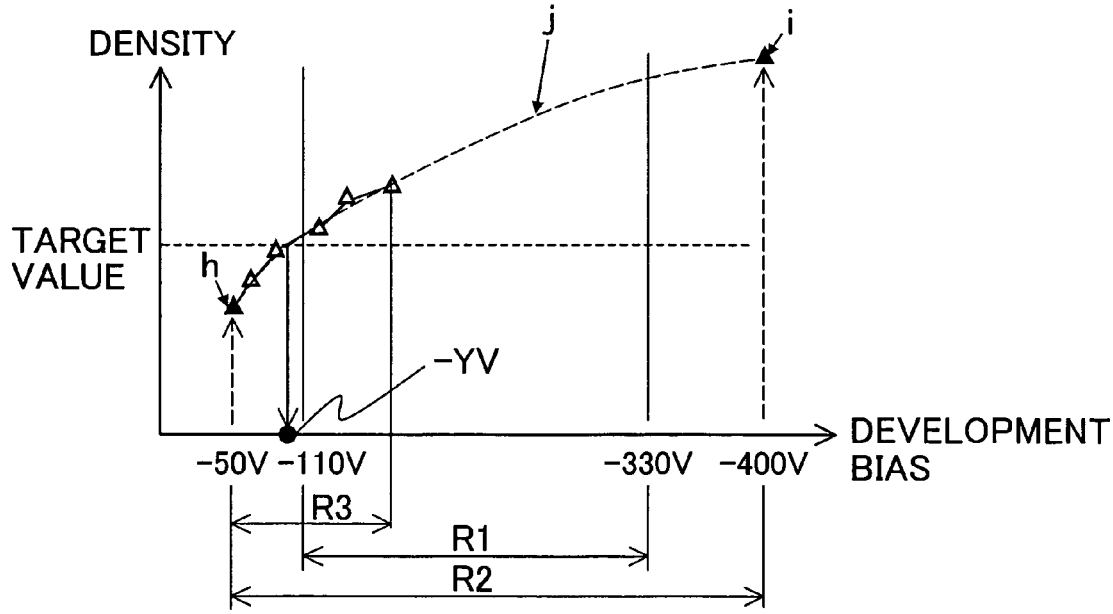

FIG. 10B illustrates an example relating to the case where the problems were judged to be absent in step S538. With respect to the patch generated by the minimum development bias value, a plot was produced in the position shown in h, and with respect to the patch generated by the maximum development bias value, a plot was produced in the position shown in i. Therefore, a characteristic such as the curve shown by j can be anticipated and the density can assume a target value in the allowed adjustment range R2. Therefore, in this case, the density adjustment is conducted. Further, for example, the range shown by R3 in the figure is determined by the adjustment range from the positional relationship of the plot points h and i.

If the adjustment range is thus determined, then the density adjustment processing is implemented by the procedure similar to that of the usual adjustment explained based on FIG. 5 (step S540). In the example shown in FIG. 10B, linear interpolation is conducted between the plot points (triangles in the figure), a development bias −YV for yielding the density of the target value is derived, and setting is conducted to this value.

Thus, with the method shown in FIG. 9B, the possibility of adjusting the development bias value in the printer 2 is checked and the adjustment processing is executed in the appropriate adjustment range only when such an adjustment is possible.

As described hereinabove, with the third method, when the toner cartridge 611 that is considered as an object is a product whose quality has not been confirmed by the manufacturer, the possibility of density adjustment in the allowed range of the printer 2 beyond the usual adjustment range is checked. Therefore, the possibility of executing the density adjustment and obtaining the image output at a good density is further increased despite the fact that product quality has not been confirmed by the manufacturer. Further, when density adjustment in the allowed range of the printer 2 is impossible, the density adjustment processing is not executed. Therefore, the situation in which the processing is interrupted by an error can be avoided.

Further, in the above-described second method, when the usual density adjustment is judged to be impossible (No in step S520 in FIG. 7A), the above-described third method may be employed without making an immediate decision that density adjustment will not be conducted. Thus, when the usual density adjustment is impossible, the adjustment range is expanded to the allowed range of the printer 2 and the possibility of adjustment is judged, and if the adjustment is judged to be possible, the density adjustment processing is implemented. As a result, there are plenty of opportunities to conduct density adjustment when the product quality has not been confirmed by the manufacturer.

As described hereinabove, with the printer 2 of the present embodiment, whether the toner cartridge 611 is a product of guaranteed quality is considered during density adjustment and the appropriate control is conducted. When the product quality has not been confirmed by the manufacturer, the control is conducted so as to maximize the possibility of density adjustment. Even when the product quality has not been confirmed by the manufacturer, the possibility of adequately conducting the density adjustment is increased and the density adjustment is prevented from being executed by the erroneous method with respect to the product whose quality has not been confirmed by the manufacturer.

In the explanation hereinabove, the adjustment of the development bias was considered as the specific example of density adjustment, but a specific contents of density adjustment may be different. For example, the present invention is also applicable to the adjustment of exposure power in an exposure unit 623 or density adjustment such as density gradation correction. Further, in the above-described embodiment, a device with a plurality of black toner cartridges 611 mounted thereon was explained, but the present invention can be also employed when CMYK toner cartridges are mounted or when one black toner cartridge is mounted. Further, in the present embodiment, the explanation was conducted with respect to the so-called four-cycle device in which printing processing is conducted sequentially for each color, but the present invention can be also applied to the so-called tandem device in which processing of all the colors is conducted in parallel.

The protection scope of the present invention is not limited to the above-described embodiment and cover the inventions described in the claims and equivalents thereof.

What is claimed is:

1. An image forming device for conducting image formation by using a toner, comprising:

development means which has detachably mounted thereon a development unit for accommodating said toner; discrimination means which discriminates whether or not the development unit mounted on said development means is a product of guaranteed quality; and control means that is means to control the density adjustment processing of the development unit mounted on said development means and serves to execute different control with respect to said density adjustment processing when the development unit is identified as a product of guaranteed quality and when the development unit is not identified as a product of guaranteed quality by said discrimination means;

wherein said control means conducts control so that said density adjustment processing is not conducted when the development unit is not identified as a product of guaranteed quality by said discrimination means.

2. An image forming device for conducting image formation by using a toner, comprising:

development means which has detachably mounted thereon a development unit for accommodating said toner; discrimination means which discriminates whether or not the development unit mounted on said development means is a product of guaranteed quality; and control means that is means to control the density adjustment processing of the development unit mounted on said development means and serves to execute different control with respect to said density adjustment processing when the development unit is identified as a product of guaranteed quality and when the development unit is not identified as a product of guaranteed quality by said discrimination means;

wherein said control means judges whether or not the density adjustment processing, which is conducted when the development unit is identified as a product of guaranteed quality by said discrimination means, is possible when the development unit is not identified as a product of guaranteed quality by said discrimination means, and conducts control such that said density adjustment processing is conducted when it is judged to be possible and the density adjustment processing is not conducted when it is judged to be impossible.

3. An image forming device for conducting image formation by using a toner, comprising:

development means which has detachably mounted thereon a development unit for accommodating said toner; discrimination means which discriminates whether or not the development unit mounted on said development means is a product of guaranteed quality; and control means that is means to control the density adjustment processing of the development unit mounted on said development means and serves to execute different control with respect to said density adjustment processing when the development unit is identified as a product of guaranteed quality and when the development unit is not identified as a product of guaranteed quality by said discrimination means;

wherein said control means judges whether or not the density adjustment processing with respect to the development unit that is not identified as said product of guaranteed quality in said image forming device is possible when the development unit is not identified as said product of guaranteed quality by said discrimination means, and conducts control such that the density adjustment processing is conducted when it is judged to be possible and the density adjustment processing is not conducted when it is judged to be impossible.

4. The image forming device according to claim 3, wherein the adjustment of a development bias value in said development means is included in the density adjustment processing controlled by said control means, and when the development unit is not identified as a product of guaranteed quality by said discrimination means, a judgment is made as to whether or not said density adjustment processing is possible within an allowed adjustment range of said image forming device that is wider than the adjustment range of said development bias value in the case where the development unit is identified as a product of guaranteed quality by said discrimination means, and the control is conducted such that the adjustment of said development bias value is conducted when it is judged to be possible and the adjustment of said development bias value is not conducted when it is judged to be impossible.

5. An image forming device for conducting image formation by using a toner, comprising:

development means which has detachably mounted thereon a development unit for accommodating said toner; discrimination means which discriminates whether or not the development unit mounted on said development means is a product of guaranteed quality; and control means that is means to control the density adjustment processing of the development unit mounted on said development means and serves to execute different control with respect to said density adjustment processing when the development unit is identified as a product of guaranteed quality and when the development unit is not identified as a product of guaranteed quality by said discrimination means;

wherein the adjustment of a development bias value in said development means is included in the density adjustment processing controlled by said control means, and when the development unit is not identified as a product of guaranteed quality by said discrimination means, a judgment is made as to whether or not said density adjustment processing is possible within an allowed adjustment range of said image forming device that is wider than the adjustment range of said development bias value in the case where the development unit is identified as a product of guaranteed quality by said discrimination means, and the control is conducted such that the adjustment of said development bias value is conducted when it is judged to be possible and the adjustment of said development bias value is not conducted when it is judged to be impossible.

* * * * *